US009869284B2

(12) United States Patent
Dominic

(10) Patent No.: US 9,869,284 B2
(45) Date of Patent: Jan. 16, 2018

(54) PROTECTION OF VEHICLE ENGINE INTAKE COMPONENTS

(71) Applicant: Toyota Motor Engineering & Manufacturing North America, Inc., Erlanger, KY (US)

(72) Inventor: Justin E. Dominic, Milan, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 165 days.

(21) Appl. No.: 14/719,456

(22) Filed: May 22, 2015

(65) Prior Publication Data

US 2016/0341159 A1 Nov. 24, 2016

(51) Int. Cl.

*F02F 7/00* (2006.01)
*F02M 35/10* (2006.01)
*F02M 35/104* (2006.01)

(52) U.S. Cl.

CPC .... *F02M 35/104* (2013.01); *F02M 35/10078* (2013.01)

(58) Field of Classification Search

CPC ..... F02M 35/1034; F02M 35/10144; F02M 35/10216; F02M 35/104; F02M 35/10078; F02F 1/4235; F02F 1/24

USPC ..... 123/195 H, 184.21, 184.34, 184.42, 123/184.47

See application file for complete search history.

(56) References Cited

U.S. PATENT DOCUMENTS 5,012,770 A * 5/1991 Okamoto ..... F02M 35/10032 123/184.42
5,887,560 A * 3/1999 Kobayashi ..... F02F 7/006 123/184.21
5,954,021 A 9/1999 Yuunaga
6,142,114 A 11/2000 Yoshikawa
7,104,256 B2 9/2006 Shin
7,258,094 B1 * 8/2007 Pelmear ..... F02F 7/0012 123/195 H
8,677,972 B2 3/2014 Kim et al.

FOREIGN PATENT DOCUMENTS

JP 2006342747 A 6/2005

OTHER PUBLICATIONS

Dominic; "Protection of Vehicle Engine Intake Components"; U.S. Appl. No. 14/719,448, filed May 22, 2015.

* cited by examiner

*Primary Examiner* — Syed O Hasan
(74) *Attorney, Agent, or Firm* — Christopher G. Darrow; Darrow Mustafa PC

(57) ABSTRACT

Vehicle engine systems and inserts for such systems are presented. The insert can be positioned between an air intake system and a cylinder bank of an engine. In some arrangements, the insert can be positioned such that a first abutment surface directly contacts portions of a surge tank and a second abutment surface directly contacts portions of a cylinder head cover. The insert can be constructed, positioned, and/or oriented to absorb or transfer forces acting upon the engine system during impacts. For instance, the insert can be arranged such that it extends between the surge tank and the cylinder head cover along an axis that is substantially parallel to a predetermined force direction of a predetermined impact force.

17 Claims, 4 Drawing Sheets

FIG. 3
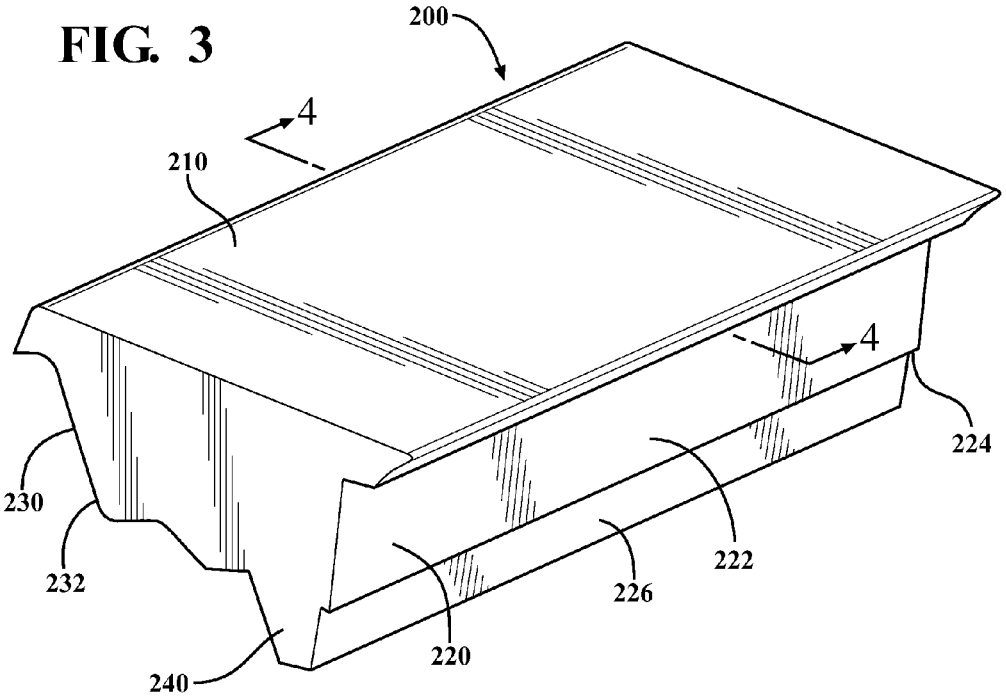
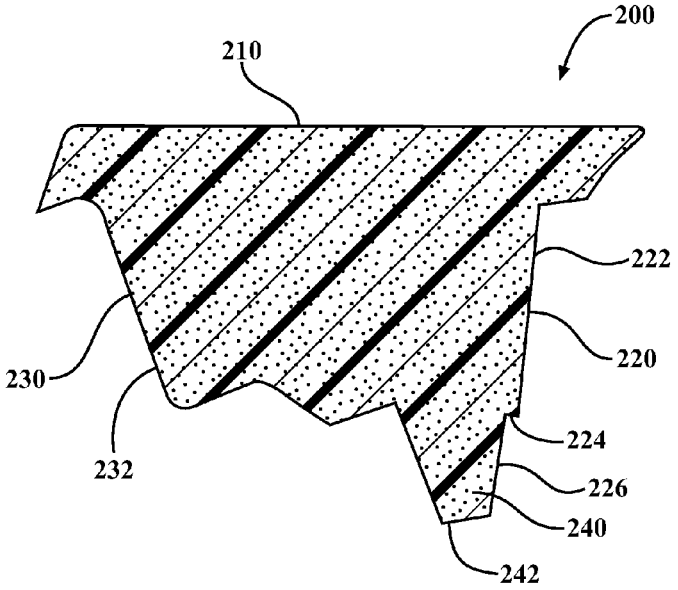
FIG. 4

PROTECTION OF VEHICLE ENGINE INTAKE COMPONENTS

FIELD

The present disclosure relates in general to engine intake components for vehicles, and, more particularly, to the protection of air and fuel intake systems for vehicle engines.

BACKGROUND

Modern vehicles, such as passenger and commercial vehicles, have various components and systems within vehicle engine systems. Examples of such components and systems can include fuel and air intakes. Air intake systems may include a surge tank and a lower inlet manifold. The lower inlet manifold connects to a portion of an engine. Fuel intake systems can include fuel delivery components. An example of a fuel delivery component is a fuel rail that is installed near the top of one or more cylinder heads of the engine system.

The intake system components can be subjected to various forces resulting from collisions, accidents, or impacts to the area of the vehicle near the engine system. For example, the surge tank may contact a dash panel during a frontal vehicle collision. Under certain impact conditions, portions of the surge tank or lower inlet manifold may fracture, break, crack, or otherwise fail. Such failure can cause damage to other engine systems or components such as an engine fuel delivery component.

SUMMARY

In one respect, the present disclosure is directed to a vehicle engine system. The engine system can include a cylinder bank having a cylinder head and a cylinder head cover. The engine system can further include an air intake system having a lower intake manifold and a surge tank. The lower intake manifold can be operatively connected to the cylinder head, and the surge tank can be operatively connected to the lower intake manifold. An insert can be positioned between the cylinder bank and the air intake system such that the insert directly contacts at least a portion of the air intake and at least a portion of the cylinder bank. The insert can be wholly or partially between the cylinder bank and the air intake system.

In another respect, the present disclosure is directed to a vehicle engine system having a cylinder bank including a cylinder head and a cylinder head cover. The engine system can further include an air intake system having a lower intake manifold connected to the cylinder head and a surge tank connected to the lower intake manifold. The system can further include an engine component extending between the cylinder bank and the air intake system. An insert can be operatively connected to the cylinder bank and the air intake system via an interference fit, and the insert can extend above the engine component while directly contacting the surge tank and the cylinder head cover.

In yet another respect, the present disclosure is directed to a method for providing an insert within an engine system. The engine system can include a surge tank and a cylinder head. The method can include positioning an insert between the surge tank and a cylinder head cover such that the insert directly contacts at least a portion of the surge tank and at least a portion of the cylinder head.

Variations in these and other aspects, features, elements, implementations, and embodiments of the methods, systems, and apparatuses are disclosed herein are described in further detail hereafter.

BRIEF DESCRIPTION OF THE DRAWINGS

FIG. 3 is a view of an exemplary insert.

FIG. 4 is a cross-sectional view of the insert, viewed along line 4-4 of FIG. 3.

DETAILED DESCRIPTION

Figure 1:
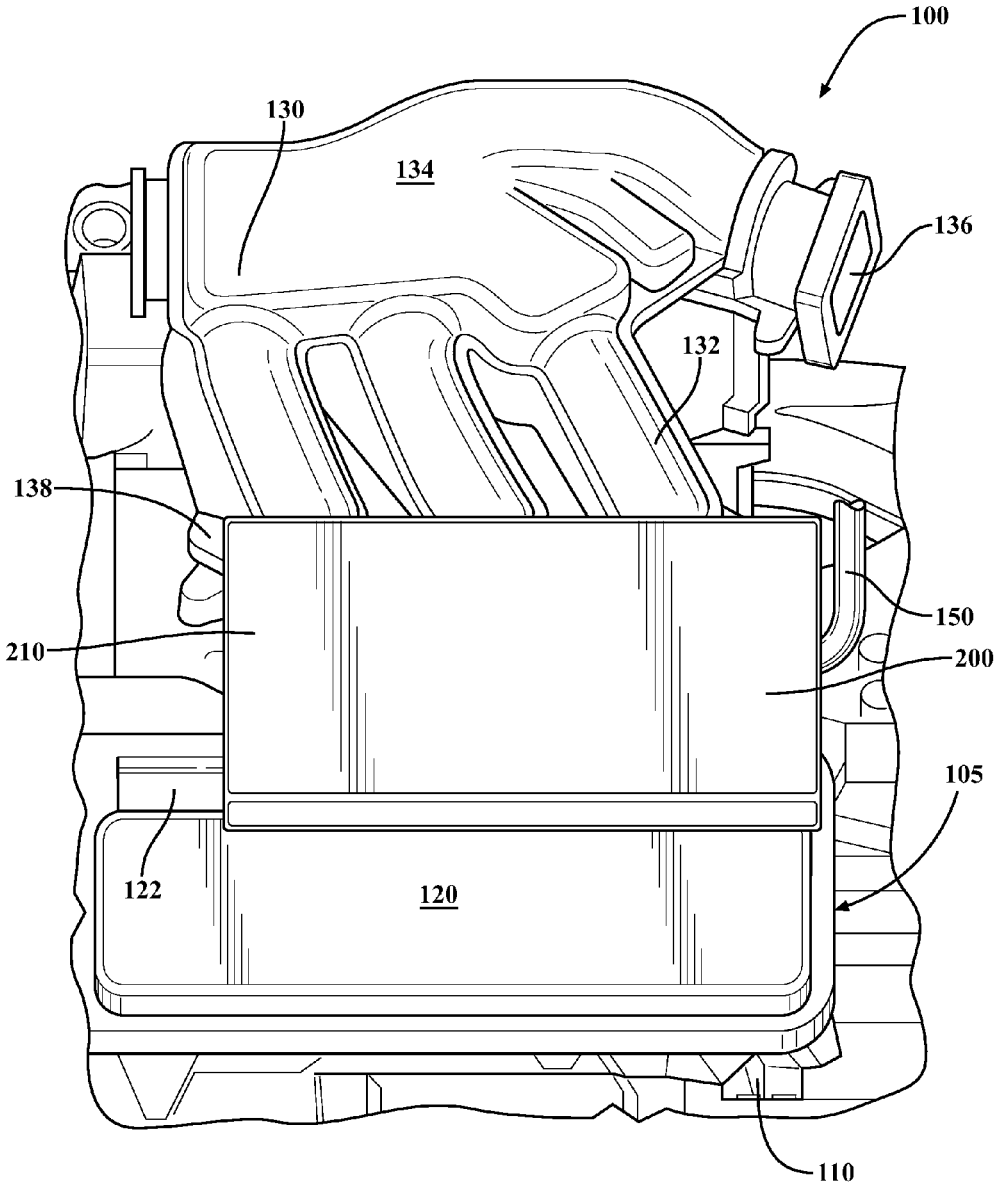
FIG. 1 is a view of an example of a vehicle engine system.

Arrangements described herein relate to the protection of one or more components within vehicle engine systems. In one or more arrangements, a vehicle engine system may include an air intake system, a fuel delivery or intake system, one or more cylinder banks, and one or more load path inserts. The intake system can include a surge tank and a lower inlet manifold. The fuel delivery system can include a fuel rail positioned in close proximity to the lower inlet manifold and/or cylinder banks. An insert may be included in the engine system such that one side of the insert is in direct contact with a portion of the air intake system while an opposing side of the insert is in direct contact with a portion of a cylinder bank. In at least some instances, the insert can reduce or prevent failure to engine system components, such as the lower inlet manifold and/or the surge tank, in the event of external force application to the engine system. For example, the insert can allow forces to be transferred from portions of an air intake system to a cylinder bank.

Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in the Figures, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

Figure 2:
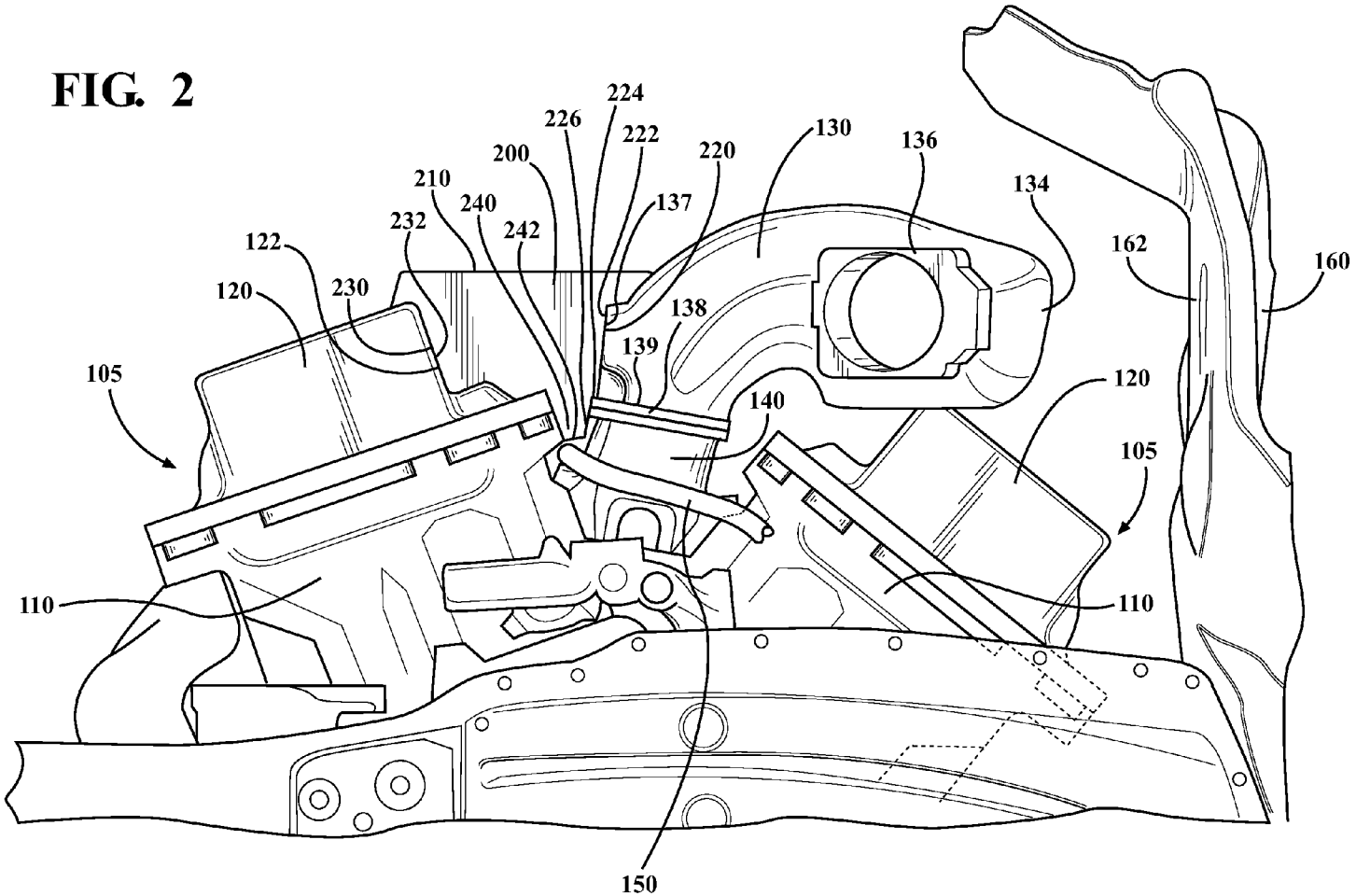
FIG. 2 is a side view of the example vehicle engine system of FIG. 1.

The general environment in which the one or more load path inserts can be used will now be described. Referring to FIGS. 1-2, an example of an engine system 100 is shown. Some of the various possible elements of the engine system 100 shown in the Figures will now be described. It will be understood that it is not necessary for the engine system 100 to have all of the elements shown in the Figures or described herein. The engine system 100 can have any combination of the various elements shown in the Figures. In one or more arrangements, the engine system 100 can include one or more elements in addition to one or more of the various elements shown in FIGS. 1-2. The term "engine" or "engine system" can be used interchangeably and can include any system or apparatus capable of converting energy into useful mechanical motion to power a vehicle. For instance, the engine system 100 can include internal combustion engines, fuel cells, and/or electric motors. As described with greater detail below, the engine system 100 can include a transverse mounted V6 internal combustion engine. The engine system 100 can be any engine system, now known or later developed.

As shown, the engine system 100 can generally include an air intake system, a fuel intake system, one or more cylinder banks, and one or more inserts. In one or more arrangements, the engine system 100 can be located in any suitable location within a vehicle, such as in an engine bay in a front portion of the vehicle. As used herein, "vehicle" means any form of motorized transport. In one or more implementations, the vehicle can be an automobile. While arrangements will be described herein with respect to automobiles, it will be understood that embodiments are not limited to automobiles. In some implementations, the vehicle can be a watercraft, an aircraft or any other form of motorized transport.

In one or more vehicular applications, a cylinder bank 105 can include one or more combustion chambers configured to allow combustion of a fuel to generate mechanical and/or electrical energy. For example, the engine system 100 can include an internal combustion engine, and the cylinder bank 105 can define multiple combustion cylinders. The cylinder bank 105 may be oriented in a variety of ways within an engine compartment of a vehicle. As described herein and as shown in the Figures, for example, a plurality of cylinder banks 105 can be transverse-mounted within the vehicle (that is, the cylinder banks can be orientated transversely with respect to a longitudinal axis of the vehicle).

In one or more arrangements, the cylinder bank 105 can include a cylinder head 110 and a cylinder head cover 120. The cylinder head 110 can have any suitable configuration based on the particular application. In one or more arrangements, the engine system 100 can include two cylinder banks 105 and thus two cylinder heads 110. The cylinder head 110 can be operatively connected to a portion of an engine block (not shown). As used herein, the term "operatively connected" can include direct and indirect connections, including connections without direct physical contact. In some arrangements of engine system 100, the cylinder head 110 and the engine block can be a unitary physical structure, that is, a structure formed from a single piece of material (e.g. by casting, machining, three dimensional printing, etc.). The cylinder head 110 together with the engine block may at least partially form the one or more combustion chambers. For example, the cylinder head 110 and the engine block may define three combustion cylinders. A second cylinder head 110 attached to the engine block may define an additional three combustion cylinders of a V-6 engine. Air, fuel, or a mixture of both can be introduced to the combustion cylinders and be converted to mechanical energy to power the vehicle. The cylinder head 110 can include additional components for engine system 100, such as valves, spark plugs, and fuel injectors. The cylinder head 110 can be operatively connected to an engine block with the connection being sealed by a head gasket.

In some embodiments, the cylinder bank 105 can include cylinder head cover 120 that is operatively connected to cylinder head 110. For instance, the cylinder head cover 120 may connect to and cover a portion of the cylinder head 110 opposite the engine block. The cylinder head cover 120 can have any suitable configuration. For instance, the cylinder head cover 120 can be shaped, arranged, oriented, positioned, and/or connected within a vehicle in any suitable manner, such as, for example, based on any combination of safety, design, space, and/or material considerations or constraints. In one or more arrangements, the cylinder head cover 120 can be a generally open rectangular in conformation. For instance, the cylinder head cover 120 can include two sets of opposing sides, a top extending to each of the four sides, and an open bottom. The cylinder head cover 120 can be removed to provide access to the cylinder head 110 and/or components retained or associated with the cylinder head 110. Additionally, the cylinder head cover 120 can be beneficial in one or more other respects, such as in the reduction of noise vibration harshness (NVH), weight, and/or material or manufacturing cost characteristics of the engine system 100, just to name a few possibilities.

In one or more arrangements, the air intake system can generally include a surge tank 130 and a lower inlet manifold 140. The surge tank 130 can be operatively connected to the lower inlet manifold 140 such that one or more interior channels or cavities of the surge tank 130 and the lower inlet manifold 140 are in fluid communication with each other. Thus, the air intake system can allow for air outside of the engine system 100 to be moved into and through the surge tank 130 and into and through the lower inlet manifold 140. The air can be introduced to specific components of engine system 100, such as the combustion chambers. As used herein, the term "air" may include any mixture of fluid. Thus, air can include environmental gas from outside engine system 100. Additionally, air may include a mix of environmental gas, exhaust gas from engine system 100, and/or any other gas or liquid additives.

The surge tank 130 can have any suitable configuration. For example, the surge tank 130 can, in one or more arrangements, define outlet tubes 132, a main portion 134, and an inlet 136. Air can be introduced into surge tank 130 via inlet 136. The inlet 136 may be operatively connected to one or more additional air intake system components, such as a throttle body (not shown). Air can transfer or pass through one or more additional components upstream of the inlet 136. For example, air exterior to a vehicle or within an engine compartment may be introduced through an air filter, an intake tube, and/or a throttle body upstream of the inlet 136. The inlet 136 can generally be an aperture defined in the main portion 134 of the surge tank 130. In one or more arrangements, the inlet 136 can be a substantially circular aperture as shown in FIG. 2. However, it will be understood that the inlet 136 is not limited to such a shape. Indeed, in one or more other arrangements, the inlet 136 can be configured in any suitable shape, such as substantially rectangular, substantially oval, substantially triangular, etc.

The main portion 134 of surge tank 130 can define an internal chamber within the surge tank 130 in which air received from the inlet 136 can accumulate. Air may collect within the chamber of the main portion 134 prior to moving to other components of engine system 100.

In one or more arrangements, the outlet tubes 132 can extend from the main portion 134. The outlet tubes 132 can define channels or tubes in fluid communication with the cavity defined by the main portion 134. The surge tank 130 can be configured to have any number of outlet tubes 132, based upon the particular application. The outlet tubes 132 can extend to an attachment flange 138. As described in more detail below, the attachment flange 138 of the surge tank 130 can be operatively connected to the lower inlet manifold 140.

The surge tank 130, including the outlet tubes 132, the main portion 134, and the inlet 136, can have any suitable size, shape, and/or configuration. The surge tank 130 can be positioned and/or operatively connected within the engine system 100 in any suitable manner. For instance, the surge tank 130 can be shaped, sized, configured, positioned, and/or operatively connected within the engine system 100 based on one or more factors, including, for example, safety, design, space, airflow requirements, and/or material considerations or constraints.

The surge tank 130 can be made of any suitable material. For instance, the surge tank 130 can be made of one or more polymers or metals. In one or more arrangements, the surge tank 130 can have a substantially uniform thickness. In one or more arrangements, the surge tank 130 can have non-uniform thickness. For instance, the surge tank 130 can have increased thickness at attachment flange 138 and/or inlet 136. Additionally, the surge tank 130 can have any suitable cross-sectional shape. For instance, the inlet 136, the main portion 134, and the outlet tubes 132 can have varying cross-sectional shape along portions of the surge tank 130.

In one or more arrangements, the lower inlet manifold 140 can be operatively connected to the surge tank 130. The lower inlet manifold 140 can also be operatively connected to the cylinder head 110. For instance, the lower inlet manifold 140 can be positioned and configured to allow air to flow from the surge tank 130 to the one or more combustion chambers of the engine system 100.

The lower inlet manifold 140 can have any suitable size, shape, and/or configuration. The lower inlet manifold 140 can be positioned and/or operatively connected within the engine system 100 in any suitable manner. For instance, the lower inlet manifold 140 can be shaped, sized, configured, positioned, and/or operatively connected within the engine system 100 based on one or more factors, including, for example, safety, design, space, airflow requirements and/or material considerations or constraints.

The lower inlet manifold 140 can be made of any suitable material. For instance, the lower inlet manifold 140 can be made of one or more metals, such as aluminum. In one or more arrangements, the lower inlet manifold 140 can have a substantially uniform thickness. In one or more arrangements, the lower inlet manifold 140 can have non-uniform thickness. For instance, the lower inlet manifold 140 can have increased thickness at and/or near the areas in which it is operatively connected to another component or structure. Additionally, the lower inlet manifold 140 can have any suitable cross-sectional shape.

The operative connection between the surge tank 130 and the lower inlet manifold 140 can be achieved in a variety of ways. For example, the surge tank 130 and the lower inlet manifold 140 can include a respective contact surface. The contact surfaces can be configured, arranged, and/or positioned to abut or contact each other. In one or more arrangements, a seal or gasket may be operatively positioned between the surge tank 130 and the lower inlet manifold 140. Furthermore, in some embodiments, portions of the surge tank 130 may extend into apertures defined in the lower inlet manifold 140. As previously mentioned, the attachment flange 138 of the surge tank 130 may be operatively connected to a top portion of the lower inlet manifold 140. In some instances, one or more fasteners may be used to operatively connect the surge tank 130 and lower inlet manifold 140. For example, a fastener can extend through apertures defined in attachment flange 138 of the surge tank 130 and a top portion of the lower inlet manifold. The fasteners can include bolts, screws, pins, and/or clips, just to name a few examples.

In one or more arrangements, the fuel intake system of engine system 100 can include a fuel line or fuel rail 150 to deliver fuel to one or more other components of the engine system 100. The term "fuel" can include any energy source useable by engine system 100. For example, fuel can include gasoline, oil, biofuel, hydrogen, ethanol, or any combination thereof. As used herein, the terms "fuel line" and "fuel rail" can be used interchangeably and include any physical structure that allows the passage of fluid there through.

The fuel rail 150 can have any suitable configuration within engine system 100. The fuel rail 150 can be positioned and/or operatively connected within the engine system 100 in any suitable manner. For instance, the fuel rail 150 can be shaped, sized, configured, positioned, and/or operatively connected within the engine system 100 based on one or more factors, including, for example, safety, design, space, fuel flow requirements, and/or material considerations or constraints. In one or more arrangements, the fuel rail 150 may be configured to deliver fuel to cylinder heads 110. For instance, the fuel rail 150 can have central portion configured to convey fuel to one or more fuel outlets (not shown). For example, the fuel rail 150 may have a number of fuel outlets matching the number of combustion chambers within a vehicle engine.

In some embodiments, the fuel rail 150 is operatively connected within the engine system 100 such that a portion of the fuel rail 150 extends proximate to at least one cylinder bank 105. For example, the fuel rail 150 can have a longitudinal axis extending near one side of a cylinder bank 105. In one or more arrangements, the fuel rail 150 may extend between cylinder head 110 and lower inlet manifold 140 as generally shown in the Figures. The fuel rail 150 can be positioned near the lower inlet manifold 140. In such position, the fuel rail 150 can be subjected to impacts or forces if portions of the surge tank 130 or the lower inlet manifold 140 fracture, move, or break off during impacts.

With reference to FIG. 2, the engine system 100 can be located near a dash panel 160. The dash panel 160 can partially define a rearward limit to an engine compartment or engine bay of a vehicle. The dash panel 160 can be shaped, positioned, and/or connected within a vehicle in any suitable manner, such as, for example, based on any combination of safety, design, space, and/or material considerations or constraints. In some arrangements, the dash panel 160 can include a dash surface 162 that generally faces the engine system 100. As further discussed below, during a vehicle crash or impact, portions of the engine system 100 may contact the dash surface 162 of the dash panel 160. In one or more arrangements, the dash panel 160 can include a portion that extends substantially vertical, or otherwise with a substantially upright orientation.

In one or more arrangements, the engine system 100 can include one or more inserts 200. As used herein, the term "insert" can mean any physical structure. The insert can absorb, transfer, resist, re-direct, and/or dampen an applied force from a physical structure in contact with the insert 200. In some instances, the insert 200 can transfer a force received from a first physical structure to portions of one or more other physical structures. The insert 200 can protect, strengthen, and/or support one or more portions of the engine system 100. For instance, as described below, the insert 200 can help to protect the surge tank 130 and/or the lower inlet manifold 140 during impacts to the engine system 100. The insert 200 can be positioned within the engine system 100 to contact two or more components therein. The insert 200 can may be in abutment or contact with the two or more components through direct and indirect contacts. For instance, the insert 200 can be in direct or indirect contact with the surge tank 130 and/or the lower inlet manifold 140 at a first abutment surface 220. The insert 200 can be in direct or indirect contact with the cylinder head 110 and/or the cylinder head cover 120 at a second abutment surface 230. In the non-limiting examples shown in FIGS. 1 and 2, the insert 200 can contact at least the surge tank 130 and the cylinder head cover 120.

The insert 200 can have any suitable configuration. FIGS. 3-4 are views of exemplary embodiments of an insert 200. As shown, the insert 200 can generally include a top 210, a first abutment surface 220, a second abutment surface 230, and a bottom 240. The terms "top" and "bottom" are used for convenience to describe the relative position of these portions of the insert 200 based on their orientation in one or more operational positions. However, it will be understood that these terms are not intended to be limiting. The first abutment surface 220 and the second abutment surface 230 can be configured to be in direct contact with one or more components within engine system 100. For instance, the first abutment surface 220 can be configured to be in direct contact with the surge tank 130 and/or the lower inlet manifold 140. The second abutment surface 230 can be configured for direct contact with the cylinder head cover 120 and/or the cylinder head 10.

The top 210 can have any suitable size, shape, and/or configuration. In one or more arrangements, the top 210 can extend in a substantially planar manner between the first abutment surface 220 and the second abutment surface 230. In one or more other arrangements, the top 210 can include one or more non-straight features. For instance, the top 210 can include one or more bends, curves, steps, or folds.

Arrangements of the first abutment surface 220 can have any suitable size, shape, and/or configuration. For instance, the first abutment surface 220 can include one or more planar features and/or one or more non-straight features. In some arrangements, the first abutment surface 220 can be shaped to substantially match the contour of other components within the engine system 100. The first abutment surface 220 can be configured to substantially matingly engage one or more surfaces of the surge tank 130 and/or the lower inlet manifold 140. For example, the first abutment surface 220 can include a first surface 222, a second surface 224, and a third surface 226.

In one or more arrangements, the first surface 222 can be configured for direct contact with a forward surface 137 of the surge tank 130, as is shown in FIG. 2. In one or more arrangements, the second surface 224 can be configured for direct contact with a top surface 139 of the attachment flange 138, as is also shown in FIG. 2. In one or more arrangements, the third surface 226 can be configured for direct contact with a forward surface of the attachment flange 138 and/or the lower inlet manifold 140. When there is direct contact between the insert 200 and one or more of these surfaces, forces can be transferred between the insert 200 and the surge tank 130 and/or the lower inlet manifold 140.

Arrangements of the second abutment surface 230 can have any suitable size, shape, and/or configuration. For instance, the second abutment surface 230 can include one or more planar features and/or one or more non-straight features. In some arrangements, the second abutment surface 230 can be shaped to substantially match the contour of other components within the engine system 100. The second abutment surface 230 can be configured to substantially matingly engage one or more surfaces of the cylinder head 110 and/or cylinder head cover 120. For example, second abutment surface 230 can include contact surface 232.

In one or more arrangements, the contact surface 232 can be configured for direct contact with a rearward surface 122 of the cylinder head cover 120. For example, the contact surface 232 can substantially matingly engage at least a portion of the rearward surface 122. When there is direct contact between the insert and the cylinder head cover 120, forces can be transferred between the insert 200 and the cylinder head cover 120.

The bottom 240 can have any suitable size, shape, and/or configuration. In one or more arrangements, the bottom 240 can extend between the first abutment surface 220 and the second abutment surface 230 opposite the top 210. The bottom 240 or one or more portions thereof can be configured for contact with one or more components of the engine system 100. In one or more arrangements, the bottom 240 can include a portion that extends near the fuel rail 150. For example, the bottom 240 can include bottom surface 242 (FIG. 4) that extends above and faces the fuel rail 150, as shown in FIG. 2. The bottom 240 can act as a shield to the fuel rail 150 by extending between the fuel rail 150 and portions of the surge tank 130 and/or lower inlet manifold 140.

It will be understood that the insert 200 shown in FIGS. 1-5 is provided merely as an example and that the insert 200 is not limited to the particular insert shown. Indeed, the insert 200 can have various suitable shapes, sizes, and/or configurations.

The insert 200 can be made of any suitable material. For instance, the insert 200 can be made of one or more polymers or metals. In one or more arrangements, the insert 200 can be made of structural foam, such as syntactic foam. The insert 200 can be substantially solid, as shown in FIG. 4, for example. In one or more arrangements, the insert 200 can be at least partially hollow. For example, the insert 200 can define one or more interior cavities or spaces. In hollow insert arrangements, the insert 200 can include walls having a substantially uniform thickness. In one or more arrangements, the insert 200 can have non-uniform thickness. For instance, the insert 200 can have increased thickness near portions of the first abutment surface 220 and/or the second abutment surface 230.

The insert 200 can be positioned and/or operatively connected within engine system 100 in any suitable way. In one or more arrangements, the insert 200 can be positioned within the engine system 100 such that the insert 200 is easily removable from the system 100. For example, the insert 200 can be retained via gravity between engine system 100 components. In some arrangements, the insert 200 can be operatively connected via an interference fit between components of engine system 100. As used herein, "interference fit" can include any press fit or friction fit, where a component is fastened or retained to physical structure via friction. For instance, friction between the first abutment surface 220 and the cylinder head cover 120 and/or friction between the second abutment surface 230 and the surge tank 130 can act to retain the insert 200 within the engine system 100. In some arrangements, the insert 200 can be operatively connected within engine system 100 via one or more attachment features. For example, the insert 200 can be operatively connected via grooves, slots, adhesives, pins, fasteners, connectors, straps, adhesives, mechanical engagement, and/or other manners of mechanical and/or chemical fastening. The insert 200 can be connected using the fasteners that operatively connect the surge tank 130 to the lower inlet manifold 140, in one example.

The insert 200 can be oriented within the engine system 100 in any suitable manner, including the orientations described herein. For instance, the insert 200 can be positioned between an air intake system and the cylinder bank 105, as shown in the Figures. The insert 200 can contact the air intake system and/or the cylinder bank 105. In some arrangements, the first abutment surface 220 of the insert 200 can directly contact the surge tank 130. The second abutment surface 230 of the insert 200 can directly contact the cylinder head cover 120. For instance, the insert 200 can extend between the surge tank 130 and the cylinder head cover 120 above the fuel rail 150.

While one insert 200 is shown in the Figures, two or more inserts 200 can be used within engine system 100. In one or more arrangements in which a plurality of inserts 200 are used, the inserts 200 can be substantially identical to each other at least with respect to their size, shape, and/or configuration. In one or more arrangements, at least one of the inserts 200 can be different from the other inserts 200 in one or more respects, such as size, shape, and/or configuration. The inserts 200 can be fixed in size, shape, and/or configuration. Alternatively, the inserts 200 can allow for the size, shape, and/or configuration to be adjustable. For example, the distance between the first abutment surface 220 and the second abutment surface 230 can be variable and/or adjustable. In one or more arrangements, at least some of the two or more inserts 200 can be attached together in any suitable manner. In one or more arrangements, the two or more inserts 200 may not be attached to each other.

In one or more arrangements, the engine system 100 can include one or more inserts 200 positioned or oriented based on impact considerations. For instance, the movement of the engine system 100 can be determined for one or more predetermined impact conditions. "Predetermined impact condition" can mean that a vehicle impacts or collides with another physical object with one or more predetermined characteristics. Examples of the predetermined impact condition can include a frontal vehicle impact, such as a frontal or overlap crash situation.

Figure 5:
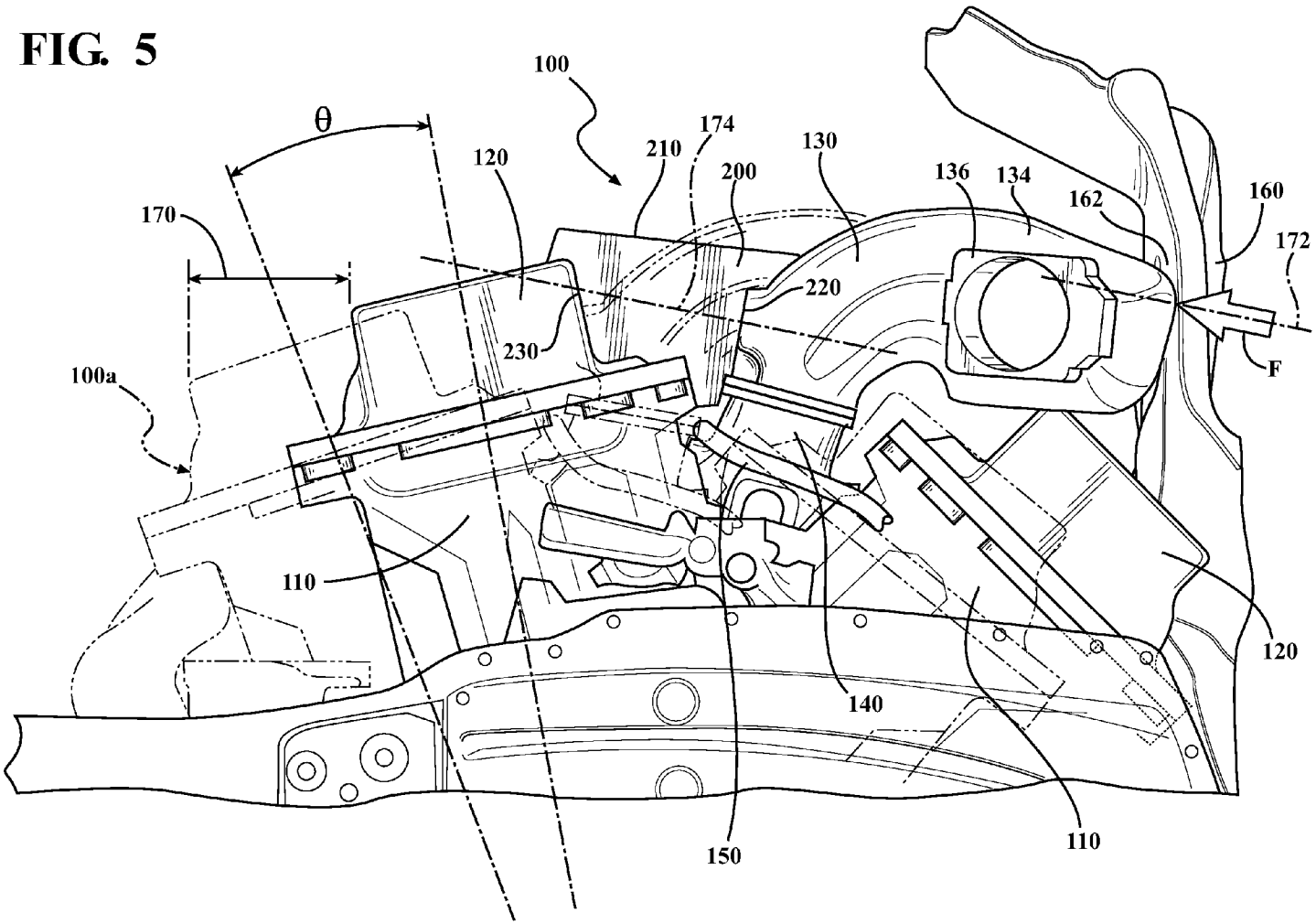
FIG. 5 is a view of an example vehicle engine system subjected to an impact force.

Responsive to the predetermined impact condition, the engine system 100 can move a distance in one or more directions. As an example, in one predetermined impact condition, the engine system 100 can move approximately a distance 170 translationally, as shown in FIG. 5. Alternatively or in addition, the engine system 100 can rotate approximately an angle Θ during the predetermined impact condition. The predetermined impact condition can result in one or more forces being applied to components of the engine system 100. For instance, a force F can be applied to the engine system 100 as a result of contact between the engine system 100 and the dash panel 160. In some arrangements, the force F can be applied to the surge tank 130 of the engine system 100, resulting from the impact between the surge tank 130 and the dash panel 160.

The force F can be estimated, approximated, and/or determined based on the predetermined impact condition. The estimation, approximation, and/or determination of the force F can be performed in any suitable manner, using any suitable technique now known or later developed. Based on the force F, an impact force direction 172 of the force F can also be estimated, approximated, and/or determined. "Impact force direction" can include the direction of the force F acting upon the surge tank 130 resulting from the contact between the surge tank 130 and the dash panel 160.

In one or more arrangements, the insert 200 can be sized, shaped, positioned or otherwise arranged based upon the predetermined impact force direction 172. For instance, the insert 200 can be arranged such that the insert 200 extends between the surge tank 130 and the cylinder head cover 120 in particular locations and/or orientations. The insert 200 can contact the surge tank 130 and the cylinder head cover 120 in particular locations and/or orientations. In some arrangements, the insert 200 can extend between the surge tank 130 and the cylinder head cover 120 along an axis 174 or along a plane containing the axis 174. For example, at least a portion of the insert 200 can continuously and uninterruptedly extend between the surge tank 130 and the cylinder head cover 120 along the axis 174. In one or more arrangements, at least a portion of the insert 200 can directly contact the surge tank 130 at a position along axis 174 and at least a portion of the insert 200 can directly contact the cylinder head cover 120 at a position along axis 174. The axis 174 can be substantially parallel to the predetermined impact force direction 172 during the predetermined impact condition. As used throughout this description, the term "substantially" includes exactly the term it modifies and slight variations therefrom. Thus, the term "substantially parallel" means exactly parallel and slight variations therefrom, such as within about +/−10 degrees for example. The insert 200 can be positioned such that, upon relative movement of the engine system 100 by the distance 170 and the angle Θ, the axis 174 will be substantially parallel to the predetermined impact force direction 172 as shown in FIG. 5.

In one or more arrangements, the insert 200 can be positioned and/or operatively connected within engine system 100 through a variety of methods. For instance, the insert 200 can be positioned between the surge tank 130 and the cylinder head cover 120. The insert 200 can directly contact the surge tank 130 and the cylinder head cover 120. The insert 200 can bridge the gap between the surge tank 130 and the cylinder head cover 120. The insert 200 can extend above the fuel rail 150. The insert 200 can be operatively connected to one or more components of the engine system 100 in any suitable manner. For instance, the insert 200 can be operatively connected through an interference fit, by one or more fasteners, and/or by one or more forms of mechanical engagement. Alternatively or in addition, the insert 200 can be operatively connected by other methods, such as the use of adhesives, welding, and/or brazing.

In one or more arrangements, methods can include positioning the insert 200 within the engine system 100 to achieve a particular orientations of the insert 200. For instance, the change in the position and/or orientation of the engine system 100 during a predetermined impact condition can be determined. For example, physical or computer-aided simulation and/or testing can determine the approximate movement and position of the engine system 100 as it contacts the dash panel 160. In one or more arrangements, the engine system 100 can be estimated to move a distance 170 and/or rotated an angle Θ during the predetermined impact condition from an original position. Such a condition is shown in FIG. 5, the movement of the engine system 100 being shown in phantom lines as 100*a*. Furthermore, the impact force F and the force direction 172 can be predetermined based on the predetermined impact condition. As described above, in some arrangements, the insert 200 can be arranged in particular orientations based on the predetermined impact condition and predetermined impact force direction 172. For example, the insert 200 can be positioned within the engine system 100 such that the insert 200 extends between the cylinder head cover 120 and the surge tank 130 along an axis 174 that extends substantially parallel to the predetermined impact force direction 172.

Methods can include other steps that are not described herein, and in fact, methods are not limited to including every step described. Furthermore, the steps detailed here as part of the method for providing a protector for one or more engine system components are not limited to this particular chronological order. Indeed, some of the steps can be performed in a different order than what is described and/or at least some of the steps can occur simultaneously.

It will be appreciated that arrangements described herein can provide numerous benefits, including one or more of the benefits mentioned herein. For example, arrangements described herein can increase the strength and/or rigidity of portions of an engine system. The insert can absorb or transfer forces during impacts to the engine system. For example, when an engine system is rotated and moved rearward during a collision, a surge tank may impact a dash panel. Rather than the force arising from the impact between the surge tank and the dash panel being transferred into a lower inlet manifold, the force may be at least partially transferred to other engine components via the insert. Estimations or determinations of the engine system position and movement can be determined to appropriately position the inserts. For example, the insert can be positioned between the surge tank and cylinder head cover along a direction parallel to an application of force upon the surge tank impacting the dash panel. Furthermore, the insert can provide other benefits, such as improved thermal and NVH characteristics.

As used herein, the terminology "example". "embodiment", "implementation", "aspect", "feature", or "element" indicate serving as an example, instance, or illustration. Unless expressly indicated, any example, embodiment, implementation, aspect, feature, or element is independent of each other example, embodiment, implementation, aspect, feature, or element and can be used in combination with any other example, embodiment, implementation, aspect, feature, or element.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein can include sequences or series of steps or stages, elements of the methods disclosed herein can occur in various orders or concurrently. Additionally, elements of the methods disclosed herein can occur with other elements not explicitly presented and described herein. Furthermore, not all elements of the methods described herein can be required to implement a method in accordance with this disclosure. Although aspects, features, and elements are described herein in particular combinations, each aspect, feature, or element can be used independently or in various combinations with or without other aspects, features, and elements.

Although features can be described above or claimed as acting in certain combinations, one or more features of a combination can in some cases be excised from the combination, and the combination can be directed to a sub-combination or variation of a sub-combination.

The above-described aspects, examples, and implementations have been described in order to allow easy understanding of the application are not limiting. On the contrary, the application covers various modifications and equivalent arrangements included within the scope of the appended claims, which scope is to be accorded the broadest interpretation so as to encompass all such modifications and equivalent structure as is permitted under the law.

What is claimed is:

1. A vehicle engine system, comprising:

a cylinder bank including a cylinder head and a cylinder head cover;

an air intake system including a lower intake manifold and a surge tank, the lower intake manifold being operatively connected to the cylinder head, and the surge tank being operatively connected to the lower intake manifold; and an insert positioned between the cylinder bank and the air intake system such that the insert directly contacts at least a portion of the air intake system and at least a portion of the cylinder bank, the insert filling a majority of the space between the cylinder head cover and the surge tank in an area in which the insert is positioned.

2. The system of claim 1, wherein the insert includes a first abutment surface, and wherein the first abutment surface directly contacts at least a portion of the surge tank.

3. The system of claim 2, wherein the first abutment surface includes a first surface and a second surface, wherein the first surface directly contacts at least a portion of the surge tank, and wherein the second surface directly contacts at least a portion of a top surface of an attachment flange of the surge tank.

4. The system of claim 3, wherein the insert includes a second abutment surface, and wherein the second abutment surface directly contacts at least a portion of the cylinder head cover.

5. The system of claim 1, further including a fuel rail that extends between the cylinder bank and the air intake system, and wherein the insert is positioned above the fuel rail.

6. The system of claim 1, wherein the insert is operatively connected within the vehicle engine system via an interference fit.

7. The system of claim 1, wherein the insert is made from a structural foam material.

8. The system of claim 1, wherein the insert is substantially solid.

9. A vehicle engine system, comprising:

a cylinder bank including a cylinder head and a cylinder head cover;

an air intake system including a lower intake manifold and a surge tank, the lower intake manifold being operatively connected to the cylinder head, and the surge tank being operatively connected to the lower intake manifold; and an insert positioned between the cylinder bank and the air intake system such that the insert directly contacts at least a portion of the air intake system and at least a portion of the cylinder bank, wherein the insert extends between the surge tank and the cylinder head cover along an axis substantially parallel to a predetermined impact force direction during a predetermined impact condition.

10. The system of claim 9, wherein the insert extends continuously and uninterruptedly along the axis.

11. A vehicle engine system, comprising:

a cylinder bank including a cylinder head and a cylinder head cover;

an air intake system including a lower intake manifold and a surge tank, the lower intake manifold being operatively connected to the cylinder head, and the surge tank being operatively connected to the lower intake manifold;

an engine component extending between the cylinder bank and the air intake system; and an insert operatively connected to the cylinder bank and the air intake system via an interference fit, the insert extending above the engine component and directly contacting the surge tank and the cylinder head cover, the insert having a lower engine-facing surface, the lower engine-facing surface including a first abutment surface shaped to directly engage a contour of the surge tank and a second abutment surface shaped to directly engage a contour of the cylinder head cover, the first abutment surface and the second abutment surface being a majority of the lower engine-facing surface.

12. The system of claim 11, wherein the insert includes a first abutment surface, and wherein the first abutment surface is shaped to substantially matingly engage a contour of at least a portion of an attachment flange of the surge tank.

13. The system of claim 11, wherein the insert includes a second abutment surface, and wherein the second abutment surface is shaped to substantially matingly engage a contour of at least a portion of the cylinder head cover.

14. The system of claim 12, wherein the engine component is a fuel line.

15. A vehicle engine system, comprising:

a cylinder bank including a cylinder head and a cylinder head cover;

an air intake system including a lower intake manifold and a surge tank, the lower intake manifold being operatively connected to the cylinder head, and the surge tank being operatively connected to the lower intake manifold;

an engine component extending between the cylinder bank and the air intake system; and an insert operatively connected to the cylinder bank and the air intake system via an interference fit, the insert extending above the engine component and directly contacting the surge tank and the cylinder head cover, wherein the insert extends between the surge tank and the cylinder head cover along an axis substantially parallel to a predetermined impact force direction during a predetermined impact condition.

16. The system of claim 15, wherein the insert extends continuously and uninterruptedly between the surge tank and the cylinder head cover along the axis.

17. A method for providing an insert within an engine system, the engine system including a surge tank and a cylinder head, the method comprising:

predicting a translational and rotational movement of the engine system within a vehicle during a predetermined impact condition; and determining an impact force direction of a force applied to the surge tank during the predetermined impact condition; and positioning an insert between the surge tank and a cylinder head cover such that the insert directly contacts at least a portion of the surge tank and at least a portion of the cylinder head and such that the insert extends between the surge tank and the cylinder head cover along an axis substantially parallel to the impact force direction during the predetermined impact condition.

* * * * *